US005348335A

United States Patent [19]

Dasarmaux et al.

[11] Patent Number: 5,348,335

[45] Date of Patent: Sep. 20, 1994

[54] DEVICE FOR ADJUSTMENT OF THE LONGITUDINAL POSITION OF AN ALPINE BINDING

[75] Inventors: Pierre Dasarmaux, Evires; Vincent Dogat, Annecy; Pascal Thomas, Chambery, all of France

[73] Assignee: Salomon S.A., Annecy, France

[21] Appl. No.: 973,715

[22] Filed: Nov. 9, 1992

[30] Foreign Application Priority Data

Nov. 8, 1991 [FR] France ..... 91 14028
Mar. 30, 1992 [FR] France ..... 92 03973

[51] Int. Cl.[5] ..... A63C 9/22
[52] U.S. Cl. ..... 280/633; 280/618
[58] Field of Search ..... 280/618, 620, 633, 634, 280/636; 441/70

[56] References Cited

U.S. PATENT DOCUMENTS

| | | | |
|---|---|---|---|
| 2,933,740 | 4/1960 | Maples | 441/70 |
| 3,785,666 | 1/1974 | Pierre et al. . | |
| 3,913,931 | 10/1975 | Kratky | 280/633 X |
| 3,958,811 | 5/1976 | Sittmann | 280/618 |
| 4,022,493 | 5/1977 | Weigl et al. | 280/633 |
| 4,302,027 | 11/1981 | Himmefsberger et al. | 280/633 X |
| 4,506,905 | 3/1985 | Krob et al. | 280/633 |
| 4,817,981 | 4/1989 | Desbiolles et al. | 280/633 |
| 4,955,633 | 9/1990 | Stritzl et al. | 280/618 X |
| 5,116,073 | 5/1992 | Goud | 280/633 X |

FOREIGN PATENT DOCUMENTS

| | | | |
|---|---|---|---|
| 0403675 | 12/1990 | European Pat. Off. | 280/618 |
| 2541471 | 6/1976 | Fed. Rep. of Germany . | |
| 3214526 | 11/1982 | Fed. Rep. of Germany . | |
| 4005446 | 8/1990 | Fed. Rep. of Germany . | |
| 2284347 | 4/1976 | France . | |
| 2496474 | 6/1982 | France . | |
| 2632200 | 12/1989 | France | 280/633 |
| 2638654 | 5/1990 | France . | |

*Primary Examiner*—Brian L. Johnson
*Attorney, Agent, or Firm*—Pollock, Vande Sande & Priddy

[57] ABSTRACT

A device for longitudinal adjustment of a binding for an alpine ski, in particular a front binding. The device comprises a base plate (9) on which the base (5) of the binding and a slide-rail fastened to the ski, along which the base plate (9) can slide longitudinally, are removably assembled so as to form a solid attachment. The base plate (9) incorporates a longitudinal positioning-locking mechanism and a control button (10) for the locking mechanism, accessible on a lateral edge of the base plate. The device comprises an arrangement for automatic blocking of the locking mechanism in its operative locked position, for as long as a voluntary maneuver is not performed in order to disengage the blocking arrangement. In particular, the housing (41) of the locking mechanism is flared, and the blocking arrangement comprises a finger (58) which cooperates with a groove (59).

15 Claims, 5 Drawing Sheets

DEVICE FOR ADJUSTMENT OF THE LONGITUDINAL POSITION OF AN ALPINE BINDING

FIELD OF THE INVENTION

The invention concerns an alpine ski binding designed to hold a boot supported on a ski and, more specifically, a device allowing adjustment of the longitudinal position of this alpine binding on the ski. The invention further relates to a device that automatically blocks a longitudinal adjustment locking mechanism.

BACKGROUND OF THE INVENTION

In general, a boot is held in place on a ski by means of a front and a rear binding. One of these bindings, most frequently the rear one, is equipped with means allowing adjustment of its longitudinal position, in order to permit use of the ski with boots of different lengths.

In some cases, the two bindings incorporate means designed to adjust their longitudinal position. This is the case for some rental bindings, which are intended for use with a broad range of boots having very different lengths. The longitudinal adjustment of the two bindings thus makes it possible to adapt the ski to a determinate boot length, and to bring the middle of the boot into substantial coincidence, with the middle of the ski.

Different devices are known which allow this adjustment of the longitudinal position of the front binding. For example, Patent No. FR 2 578 534 describes a front binding whose base moves along a slide-rail. The means allowing adjustment of the longitudinal position of the base incorporate, in the base, lateral teeth which cooperate with slots in the slide-rail and a kind of cam which forces the teeth to engage in the slots. A device of this same type is described in Patent Application No. FR 2 632 200.

These devices require a tool for achieving longitudinal adjustment. Moreover, the base of the binding is specifically intended for this application, i.e., it is specially configured for the purpose of longitudinal adjustment.

In addition, Patent Application No. EP 169 315 discloses an adjustment device designed to equip a front binding. This device comprises a control lever whose actuation controls the insertion of a rod in one of the slots in a slide-rail. As in the preceding case, the device requires a specific configuration of the binding, i.e., the entire binding must be designed and produced based on the existence of this equipment.

French Patent No. 2 284 347 discloses an adjustment device comprising three main parts which move longitudinally in relation to each other. This device comprises, first, a base plate attached to the ski. A support plate is guided on the central part of the base plate, whose position is determined by a mobile slider carried by the base plate. Finally, a guide plate is guided on the lateral wings of the base plate and moves in relation to the support and against the force exerted by return springs.

The disadvantage of this device lies in its complexity. Indeed, it comprises three parts which slide in relation to each other.

Furthermore, this device is not practical, since the slider is carried by the element attached to the ski. It is not possible to manipulate the slider and shift the binding simultaneously with one hand.

Finally, this device cannot be used for all bindings, in particular for front bindings. In effect, the return springs belonging to the guide plate do not prove useful for these bindings. The device is actually designed for rear bindings and is intended to receive only the body of the rear binding, not the binding in its entirety.

SUMMARY OF THE INVENTION

One of the objects of the present invention is to propose a longitudinal adjustment device for a binding which may be used with standard bindings, in particular front bindings.

Another object of the invention is to propose a device allowing longitudinal adjustment, without requiring a special tool.

A further object of the invention is to propose a device which can be easily controlled and demands of the user only natural movements.

An additional object of the invention is to propose a device whose operation is reliable, i.e., a device for which the risk of untimely release is totally limited.

The adjustment device according to the invention is designed to equip a binding comprising a device for holding the end of a boot in place, a body, and a base by means of which the binding can be assembled to a ski. The adjustment device comprises, in addition, a longitudinal slide-rail attached to the ski and along which the binding can slide, and means for locking the binding in place on the slide-rail, in at least two different longitudinal positions.

The adjustment device comprises a base plate to which the binding base is assembled so as to form an attachment. The base plate is mounted so as to slide on the slide-rail and is equipped with a longitudinal positioning-locking mechanism and with a control button allowing the locking mechanism to be maneuvered.

This device also incorporates locking means for automatically immobilizing the locking mechanism in its locked position as soon as a longitudinal thrust in a determinate direction is exerted on the base, and for as long as voluntary action is not exerted in the opposite direction so as to disengage these locking means.

BRIEF DESCRIPTION OF THE DRAWINGS

The invention will be better understood by referring to the following description and to the attached drawings, in which several embodiments of the invention are shown for purposes of illustration.

DESCRIPTION OF THE PREFERRED EMBODIMENT

Figure 1:
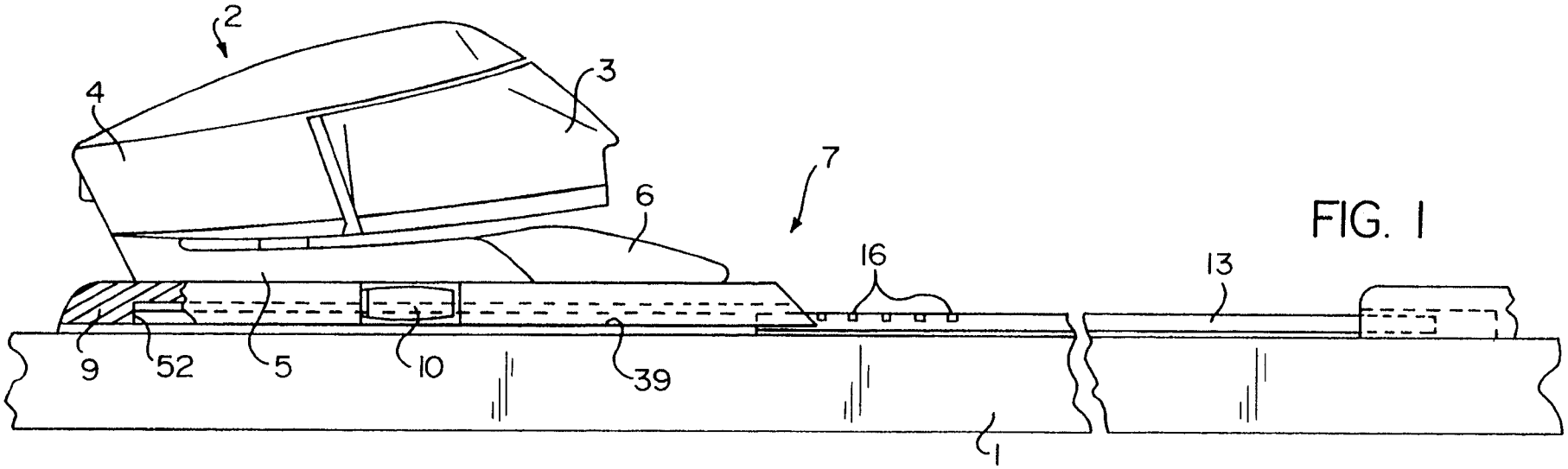
FIG. 1 is a side view in partial cross-section of the adjustment device equipped with a front binding.

FIG. 1 is a partial view of a ski 1 to which a binding 2 is assembled. The binding shown is a front binding and, as will be made clear below, this binding may be of any suitable type. It is, advantageously, a standard binding identical to components assembled directly on a ski.

The binding 2 incorporates, in conventional fashion, a position-retention device 3 for holding the front end of a boot, a body 4, and a base 5. The base 5 is extended rearward by a support plate 6 on which the front end of the boot rests. These components are found in virtually all existing bindings.

A device 7 for longitudinal adjustment of the binding is positioned between the binding and the ski. This device 7 comprises mainly a slide-rail 8 fastened to the ski (to be described below in greater detail) and a base plate 9 mounted on the slide-rail 8 which imparts to it a longitudinal sliding motion. The base plate has an upper surface whose dimensions are approximately those of the base 5 and the binding support plate 6. The base 5 is assembled to the base plate 9 so as to form a solid attachment, preferably in a removable fashion using any suitable means, e.g., screws.

The base plate 9 is, moreover, equipped with a locking mechanism which cooperates with the slide-rail to delimit at least two different longitudinal positions for the base plate 9. The locking mechanism makes it possible to lock the base plate 9 in each of these positions, and a button 10 preferably accessible on one of the lateral sides of the base plate 9, makes it possible to operate the locking mechanism.

The adjustment device is formed from elements separate from the binding, and thus it constitutes a subassembly that is independent of the binding itself. The binding can thus be interchanged with another standard binding of the same type, without changing the adjustment device. Furthermore, bindings of a different type can be mounted on the device when the base plate 9 incorporates assembly means suitable for each type of binding, e.g., several sets of holes matching the assembly holes in the various binding models.

Figure 2:
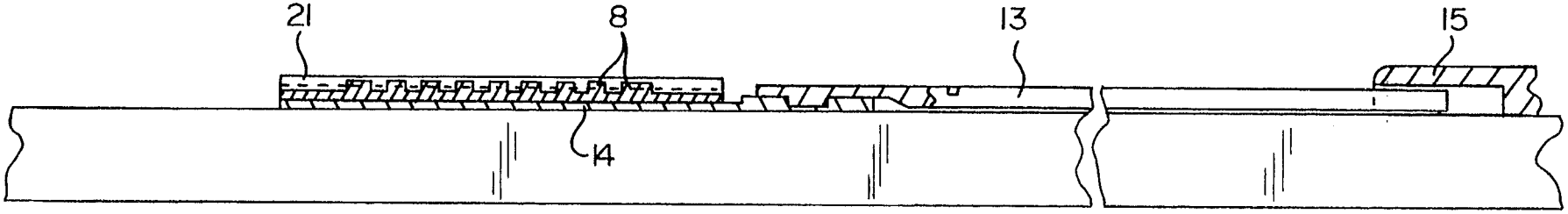
FIG. 2 is a cross-section view, in a longitudinal, vertical plane, of the adjustment device of FIG. 1.

In one preferred embodiment, the slide-rail 8 is extended rearward by a lengthwise tongue 13. As illustrated in FIGS. 1 and 2, for example, the front portion of this tongue is assembled to an interface plate 14 inserted between the slide-rail 8 and the upper surface of the ski. In addition, the tongue 13 extends rearward, where it is engaged beneath the base plate, or the base of the rear binding (shown schematically at 15). In this area, the end of the tongue 13 can freely slide longitudinally.

As appears in FIG. 1, the rear part of the base plate 9 overlaps the tongue 13. Advantageously, the tongue has successive markings 16, each of which comes to coincide with the rear end of the base plate 9 at each longitudinal position that the base plate can occupy. The tongue and the markings 16 thus make it possible to identify very quickly and easily the position in which the front binding is placed.

Figure 3:
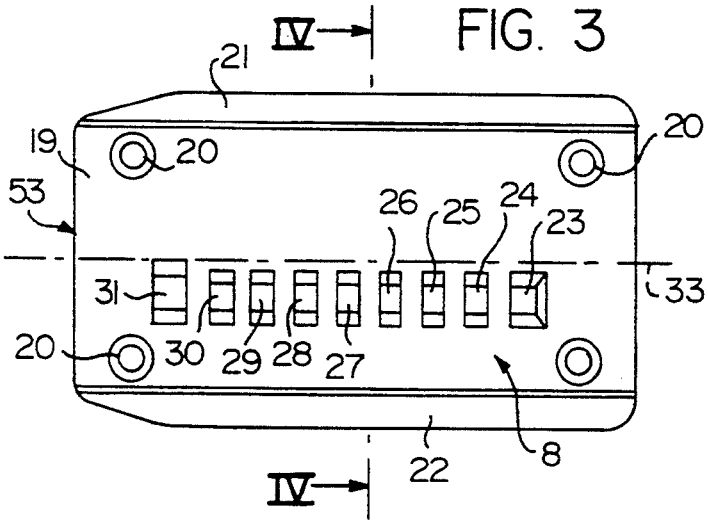
FIG. 3 is a top plan view of the slide-rail forming one of the components of the device of FIG. 1.
Figure 4:
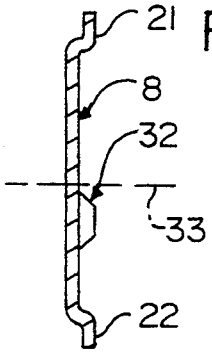
FIG. 4 is a side view in cross-section of the slide-rail shown in FIG. 3.

FIGS. 3 and 4 illustrate the slide-rail 8 in greater detail. This slide-rail has a generally rectangular shape and comprises a central portion 19 containing screw holes 20 for assembly to the ski. Laterally, the slide-rail has two raised longitudinal wings 21 and 22 along which the base plate 9 will be guided.

In its central section 19, the base plate 8 has a plurality of teeth 23 to 31 aligned along a longitudinal axis, which delimit identical tooth spaces.

FIG. 3 illustrates nine teeth delimiting eight tooth spaces between them. This number is, of course, not limiting, any other number can be used.

As shown in FIG. 4, each tooth preferably has a trapezoidal section, with a large base positioned on the upper surface of the slide-rail and the small base, in the upper part of the tooth. Accordingly the teeth incorporate laterally at least one inclined surface 32, whose function will be described hereinbelow.

FIGS. 3 and 4 show that the teeth 23 to 31 are slightly offset in relation to the median longitudinal axis 33 of the slide-rail, and the surface 32 is positioned facing this axis 33. This arrangement corresponds, however, to one preferred embodiment and is not restrictive for the invention.

Also according to a preferred embodiment, the first tooth, i.e., tooth 23, has a longitudinal dimension greater than that of the other teeth, while the last tooth, i.e., tooth 31, extends further in the direction of the axis 33 than do the other teeth. The reason will be explained below.

Figure 5:
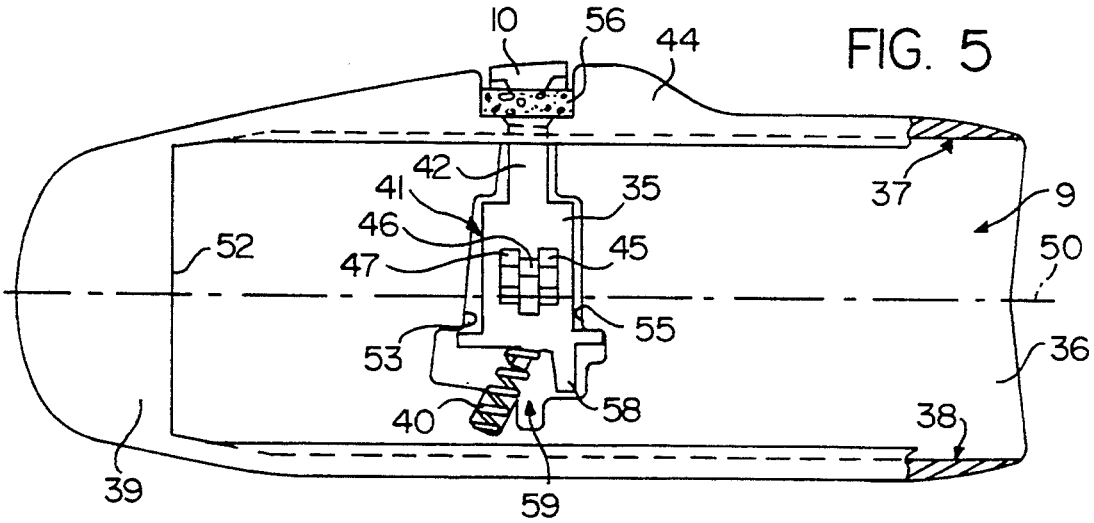
FIG. 5 is a bottom plan view of the base plate belonging to the device illustrated in FIG. 1, in one of its working positions.
Figure 6:
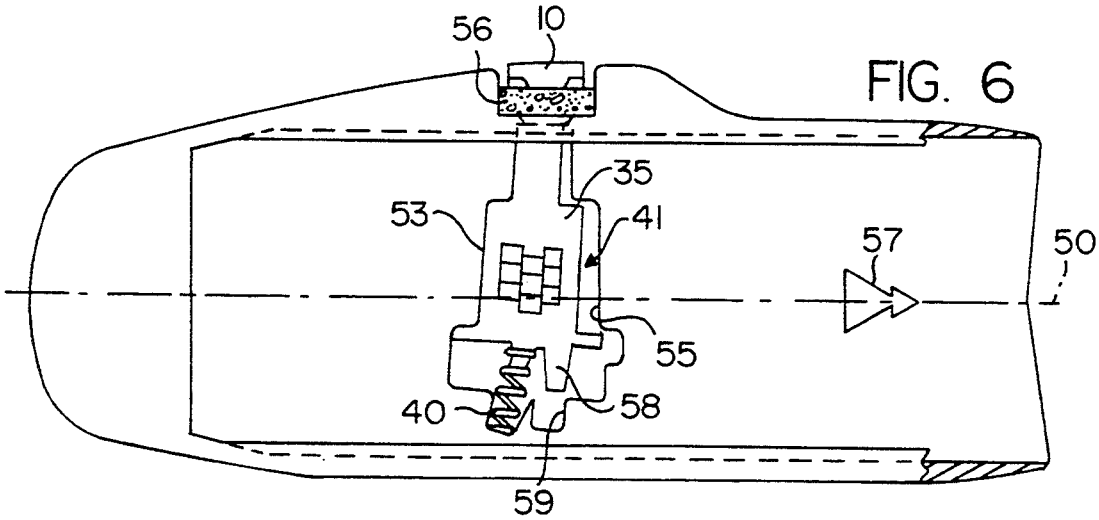
FIG. 6 is a bottom plan view of similar to FIG. 5 showing a different working position.

FIGS. 5 and 6 are bottom plan views illustrating the base plate 9 equipped with its locking mechanism 35. The base plate 9 has a longitudinal recess 36 opening toward the rear and bounded laterally by two longitudinal grooves 37 and 38. The transverse dimensions of the grooves 37 and 38 are determined such that the base plate 9 can slide freely along the slide-rail 8, while at the same time being held vertically in place upward and downward. The base plate 9 preferably has, on its lateral and front edges, a shoulder 39 which extends downward as close as possible to the upper surface of the ski, so as to block snow and dirt from penetrating into this area. The grooves 37 and 38 are cut into the lateral parts of this shoulder.

In the central portion of the base plate 9, a locking mechanism 35 is guided as it travels transversely against the return force of a spring 40. For example, as illustrated, the base plate 9 has a transverse housing 41 along which the locking mechanism 35 is guided. This locking mechanism 35 is extended laterally by a tongue 42, at the end of which the control button 10 is located. The button 10 is accessible on a lateral edge of the base plate 9, and the base plate 9 preferably incorporates at this location a lateral bulge 44 on either side of the button, which envelops the button within the contour of the base plate.

According to a preferred embodiment, the locking mechanism 35 incorporates, in its central section, a set of three teeth 45, 46, and 47, the two end teeth 45 and 47 being longitudinally aligned and the central tooth 46 being offset transversely in relation to the two preceding teeth in a direction away from the button 10. In the embodiment shown, the axis on which the two teeth 45 and 47 are aligned is offset toward the button 10 in relation to the median longitudinal axis 50 of the base plate 9.

The width of the two end teeth 45 and 47 is substantially equal to the width of the tooth spaces on the slide-rail 8. The width of the central tooth 46 is substantially equal to the width of one of the intermediate teeth 24 to 30 on the slide-rail 8.

Preferably, at least the central tooth 46 has, on the side facing the button 10, an inclined surface 48 whose inclination is substantially identical to that of surface 32 of teeth 24 to 30. Thus, when the base plate 9 is engaged on the slide-rail 8, the spring 40 belonging to the locking mechanism 35 draws the teeth 45, 46, and 47 toward the teeth 23 to 31 on the slide-rail 8. Teeth 45 and 47 are designed to engage in the tooth spaces, while central tooth 46 abuts against one of the teeth 24 to 30 on the slide-rail 8. The effect of the inclination of surfaces 48 and 32 is to transform the transverse force of the spring 40 into a vertical upward force exerted on the base, when the tooth 46 is supported on one of the teeth 24 to 30. This arrangement contributes to reducing vertical play between the base plate 9 and the slide-rail 8, at least in the absence of a boot.

As previously noted, the first tooth 23 is wider than the other teeth on the slide-rail 8, and thus greater than the central tooth 46 on the locking mechanism. Accordingly, the fact that the locking mechanism 35 cannot be positioned in relation to the tooth 23 ensures that the teeth 45 and 47 are always positioned between two teeth on the slide-rail 8, whatever the longitudinal position adopted by the base plate 9. Thus, the eight tooth spaces delimit seven different positions.

When longitudinal adjustment of the base plate 9 brings the teeth on the locking mechanism into the area of the first tooth 23, an arrangement corresponding to the backward-shifted position of the base plate 9, the front part 52 of the shoulder 39 of the plate 9 is stopped against the front edge 53 of the slide-rail 8, thereby restricting the backward movement of the base plate.

This is not, however, a limiting arrangement. The backward movement of the base plate 9 could equally well be limited by extending the tooth 23 toward the median longitudinal axis 33, in the same way as the tooth 31.

As regards forward motion, it was previously stated that the last tooth 31 extends farther toward the axis 33 than do the others. It will thus be understood that, to pass over this tooth 31, the locking mechanism 35 must move laterally over a greater distance than that required to pass over the other teeth.

FIG. 5 illustrates a preferred embodiment, in which a block 56 of a compressible material, e.g., closed-cell foam, is inserted between the button 10 and the lateral wall of the base plate 9. The function of this block is to fill the space between the button and the base plate, and thus to avoid infiltrations of snow and dirt in this area.

In addition, it reinforces the elastic return of the locking mechanism 35 in cooperation with the spring 40.

Furthermore, the more the block is compressed, the more rapidly the force it opposes to the motion of the locking mechanism increases. Thus, to drive the locking mechanism to the end in order to release the locking mechanism from the offset tooth 31, it will be necessary to push the locking mechanism back with a much greater force than that required to release the locking mechanism from the intermediate teeth 24 to 30.

The shift from the operative to the non-operative position is effected by simple pressure on the button 10, which forms the locking mechanism-operating means. The spring 40 provides for the elastic return of the locking mechanism into operative position.

The longitudinal adjustment device is, moreover, equipped with means for automatically immobilizing the locking mechanism in the operative locking position.

As shown in FIG. 5, the locking mechanism 35 has two parallel lateral edges, and the housing 41 inside which the locking mechanism is guided has, when seen from above, a flared shape, including one wall 55 substantially perpendicular to the median longitudinal axis 50 of the plate 9 and a front wall 53 which is inclined in relation to this median axis, so that play exists between the locking mechanism and the housing located on the side of the locking mechanism facing the button 10.

Moreover, as illustrated in FIG. 5, the axis of the spring 40 exerting a return force on the locking mechanism slopes in relation to a direction perpendicular to the median longitudinal axis 50, so that the thrust of the spring elastically forces the locking mechanism back to a resting position against the wall 55 positioned toward the rear side of the plate 9.

In this configuration, the locking mechanism 35 can swivel, in the horizontal plane shown in FIG. 5, between a first position (FIG. 5) in which the locking mechanism rests against the wall 55, and a second position (FIG. 6) in which, after a rocking motion, the locking mechanism rests against the wall 53.

The locking mechanism 35 can be made to pivot from one position to the other by slightly shifting the binding or the base plate longitudinally to the front or rear. In fact, to describe this motion, the locking mechanism is held by its teeth and pivots, so to speak, around one of its teeth 24 to 30 on the slide-rail, while being connected to the base 9 in the area of its tongue 42.

Rearward motion is achieved by voluntarily acting on the binding or the base plate. Forward movement also occurs using a voluntary maneuver, or else is produced automatically when the boot is engaged in its bindings. It is known, in fact, that the boot, when present, continuously exerts a forward thrust on the front binding.

However, according to a preferred embodiment, because of its inclination and the return force it generates, the spring 40 forces the base 9 back elastically toward the front as soon as the locking mechanism is returned to an operative locking position and all voluntary action ceases to be exerted on the plate 9.

In the forward-shifted position of the binding, i.e., the position shown in FIG. 5, the blocking means are operational and prevent any movement of the locking mechanism toward its inoperative position. On the other hand, when the base plate 9 is in the backward-shifted position illustrated in FIG. 6, the immobilization means are inoperative, and the locking mechanism can be maneuvered into its non-operative position in which longitudinal adjustment can be effected.

In FIG. 5, the blocking means are illustrated in the form of a finger 58 which is located at the end of the locking mechanism, on the side remote from button 10, and which cooperates with a groove 59 in the housing. The finger extends along the transverse axis of the locking mechanism, and the grooves extends substantially parallel to the inclined wall 53.

In the operative position of the locking mechanism, i.e., in the position shown in FIG. 5, the finger is disengaged from the groove and is shifted out of its alignment. In fact, the finger 58 lies opposite the edge of the groove 59 and thus prevents any motion of the locking mechanism toward its non-operative position, since it then abuts against the edge of the groove 59.

Figure 7:
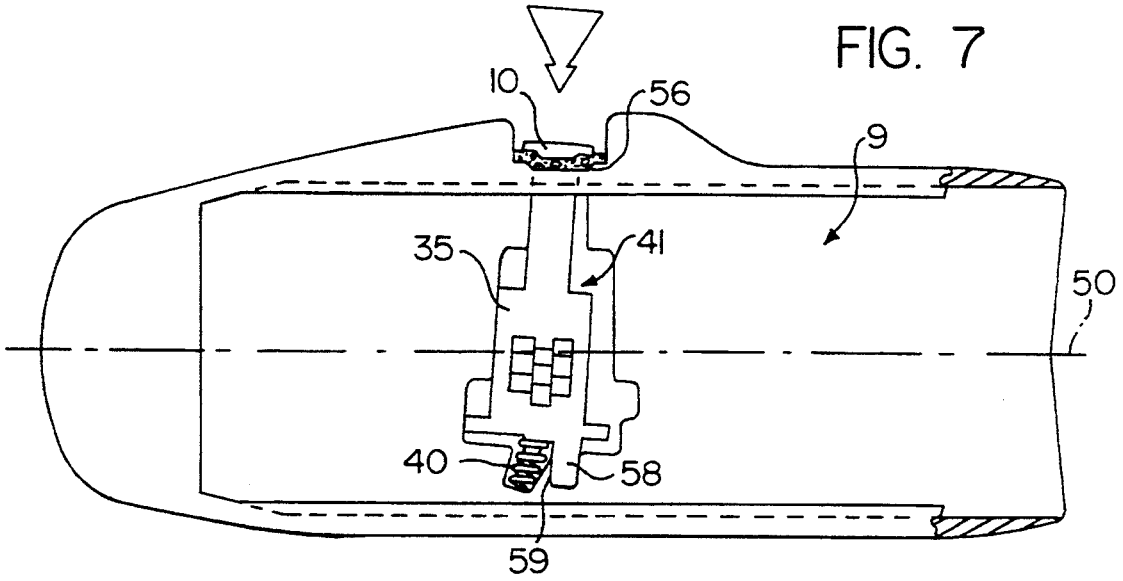
FIG. 7 shows the device in FIG. 6, of a different working position.

Following a voluntary rearward maneuver (shown schematically by arrow 57) exerted on the binding or the plate 9, the locking mechanism swivels into the position illustrated in FIG. 6. In this position, the finger 58 comes into alignment with groove 59. It is then possible to draw the locking mechanism into its non-operative position, which is achieved when the finger 58 enters inside the groove 59. FIG. 7 shows the adjustment device in that position. The longitudinal position of the binding can then be adjusted so as to bring the teeth on the locking mechanism into position facing another tooth on the slide-rail.

. It should be noted that the spring 40 ensures the elastic return of the locking mechanism into its operative locked position, and that it also tends to bring the locking mechanism 35 back into the position in which the blocking means are operational. However, should this not occur, this position will be reached when the boot is engaged in the binding. Indeed, any forward motion generated on the binding or on the plate 9 brings the blocking means into their operative position, thus ensuring that, especially when skiing, no untimely release can occur.

However, according to a preferred embodiment, the spring 40 is sufficiently strong to draw the base forward as soon as the locking mechanism is released. Thus, the blocking means are automatically brought back into operative position.

Figure 8:
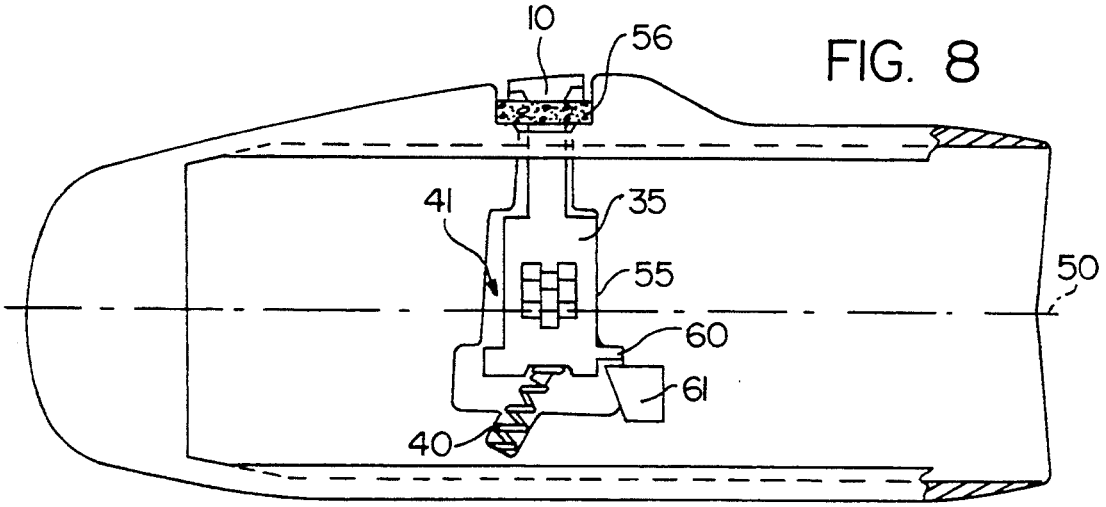
FIG. 8 illustrates a variant.
Figure 9:
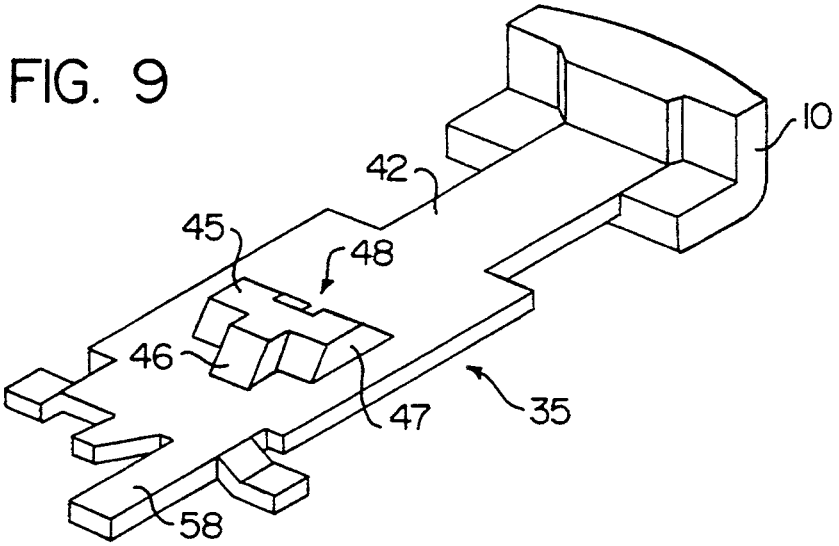
FIG. 9 is a perspective view of the positioning-locking mechanism and of its control button.

FIG. 8 illustrates a variant, in which the blocking means comprise a lateral stop 60 intended for the locking mechanism and projecting on the side facing the wall 55 of the housing 41, which cooperates with a stop 61 on this projecting wall.

In the operative position of the blocking means, i.e., the position in which the locking mechanism 35 rests against the wall 55, the two stops 60 and 61 abut against each other, and any movement of the locking mechanism toward its non-operative position is impossible. When the locking means are in non-operative position, i.e., following a rearward motion of the plate 9, the lateral stop 60 releases from the stop 61 on the wall 55, thus allowing the locking mechanism to move into its non-operative position. As in the preceding case, the spring 40 ensures that the locking mechanism will be elastically returned to its operative position, and it also tends to draw the locking mechanism back into the operative position of the blocking means.

Figure 10:
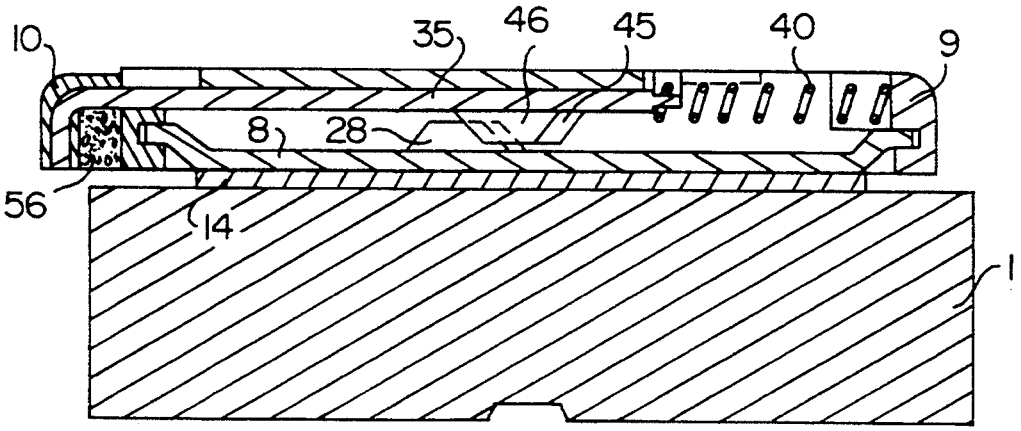
FIG. 10 is a front view, in cross-section in a transverse, vertical plane, of the device of FIG. 1, in one of its working positions.
Figure 11:
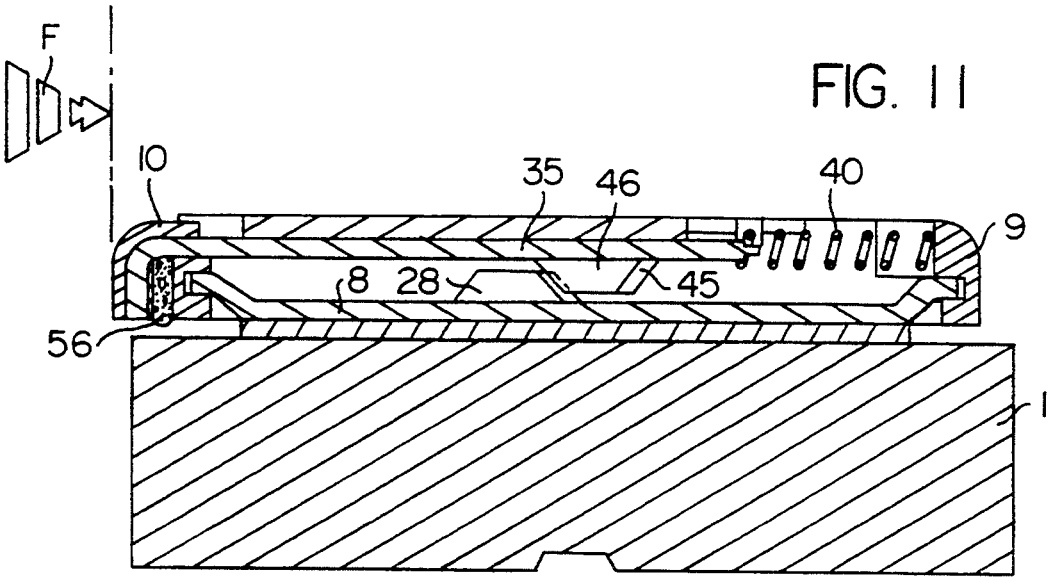
FIG. 11 is a view similar to FIG. 10, but in another working position of the device.
Figure 12:
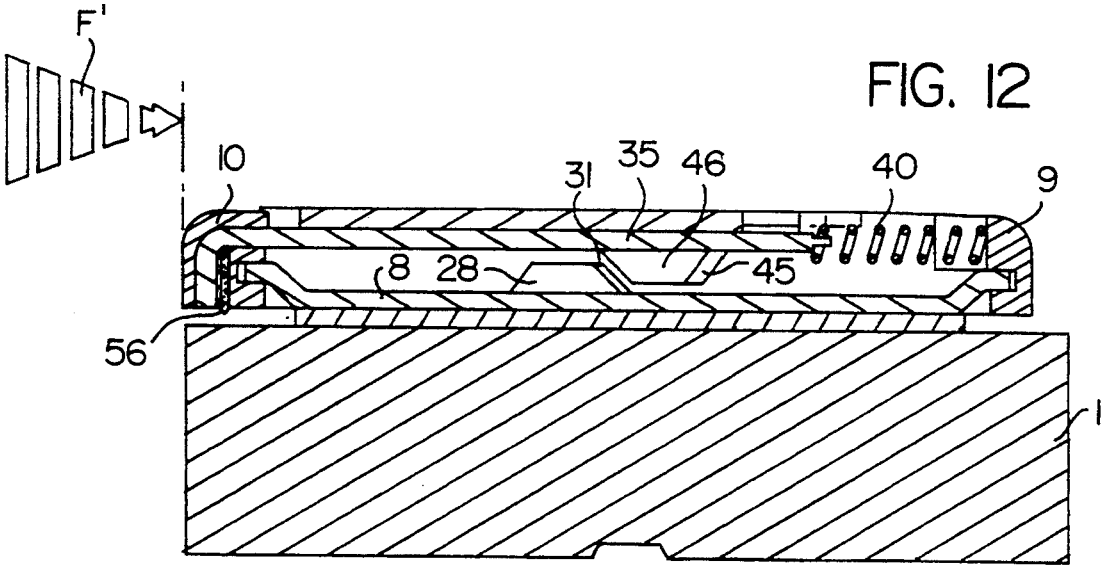
FIG. 12 illustrates the same device as FIGS. 10 and 11, but in a different working position.

FIGS. 10 to 12 illustrate the adjustment mechanism in its various operating positions. FIG. 10 shows the normal skiing position, the locking mechanism 35 being engaged on one of the teeth 24 to 30 on the slide-rail 8. In FIG. 11, a transverse force "F" is exerted on the button 10. The teeth on the locking mechanism then release from the teeth 24 to 30 on the slide-rail, but their motion is not sufficient to allow passage over the last tooth 31. The foam block 56 is compressed.

In FIG. 12, a force F' greater than F allows maximum movement of the locking mechanism 35, and the teeth on the locking mechanism thus disengage from the teeth 24 to 31. The foam block 56 is totally compressed. The base plate can be taken off the slide-rail toward the front. This arrangement proves useful, for example, for replacement of the entire product, or to disassemble the binding from the base plate in order to repair or replace it.

It should be indicated, finally, that, in accordance with a preferred embodiment, the button 10 is located on the left side of the base, on the rear part of the body 4 of the binding.

This arrangement takes into account the normal position of the ski during adjustment, with the tip on the left side of the technician who performs the adjustment. With his left hand, he grasps the body of the binding. His thumb is then naturally located in the area of the push-button 10, which he can operate very simply. Thus, the technician performs in succession, quite naturally and with his left hand, the movements necessary for working the locking mechanism 35, shifting the base plate 9, and then releasing the locking mechanism when the desired position is reached. The reference marks 16 on the tongue 13, which were described with reference to FIG. 1, accordingly help the technician to position the base plate 9 in one of the longitudinal positions determined by the teeth on the slide-rail 8.

It is evident that the adjustment device just described could be adapted for a rear binding. It would be necessary only to modify the horizontal dimensions of the base plate 9 to allow it to receive the base of a rear binding.

In addition, the adjustment device just described is designed to equip a base plate separate from the binding. However, it could also be incorporated directly into the base of a binding, and the base would then be directly engaged on the slide-rail.

The walls 55 and 53 of the housing 41 and the direction of movement of the locking mechanism could also be arranged differently than described.

Furthermore, play between the locking mechanism and its housing could be produced by means of two parallel walls of the housing 41 and non-parallel lateral edges of the locking mechanism, or by any other means.

Finally, the present device could equip any device used to longitudinally adjust an accessory on a ski, or even on a sliding board.

What is claimed is:

1. Device for longitudinal adjustment of an alpine ski binding, designed to hold a boot supported on a ski, said binding comprising a position-retention device (3) for holding an end of a boot, a body (4), and a base (5) supporting said body by which said binding may be assembled to said ski, said adjustment device further comprising a longitudinal slide-rail (8) attached to said ski and along which said binding can slide, and means for blocking said binding on said slide-rail in at least two different longitudinal positions, said device comprising a base plate (9) with an upper surface for supporting said base (5) of said binding, said base plate (9) being mounted so as to slide on said slide-rail (8) and incorporating a longitudinally-positioned locking mechanism (35), spring means (40) being housed in said base (5) for elastically returning said locking mechanism (35) to locking position, and a transversely movable control button (10) operatively connected to said locking mechanism (35) for controlling opening of said locking mechanism, wherein said slide-rail (8) comprises a central portion having longitudinally aligned teeth (23–31) delimiting between said teeth at least two tooth spaces, and wherein locking mechanism (35) having a free end equipped with a control button (10) accessible on a lateral edge of said base plate, said locking mechanism incorporating three juxtaposed teeth (45, 46, 47) distributed in a longitudinal direction, including two longitudinally aligned end teeth (45, 47) and a central tooth

(46) set back transversely, said end teeth engaging in two successive tooth spaces of said slide-rail under the elastic force of a blocking mechanism return spring (40), said central tooth (46) coming into abutment against a tooth of said slide-rail adjacent to said two tooth spaces, cooperating with said tooth spaces on said slide-rail by transverse engagement, so as to immobilize said base plate (9) longitudinally.

2. Safety binding for an alpine ski, designed to hold an end of a boot supported on a ski, wherein said binding is equipped with a device according to claim 1, for adjustment of the longitudinal position of said safety binding on said ski.

3. Device according to claim 1, wherein a lateral surface (48) of said central tooth (46) on said locking mechanism and lateral surfaces (32) of said teeth (24–30) on said slide-rail (8) cooperate and are inclined in a vertical, transverse plane and have substantially identical inclinations.

4. Device according to claim 1, wherein a last tooth (31) at one end of said slide-rail has a larger transverse dimension than the other teeth, so that the clearing of said last tooth (31) by the locking mechanism (35) requires said button (10) to move over a distance greater that the distance needed for clearing said other teeth (24–30).

5. Device according to claim 1, wherein a block of compressible material (56) fills the space between said button (10) and said base plate (9).

6. Device for longitudinal adjustment of an accessory for a sliding board designed to hold a boot in place on an alpine ski, a binding comprising a body and a base (9) by which said binding is fastened to the ski, said adjustment device comprising a longitudinal slide-rail (8) attached to the ski and along which said base (9) can slide, means for blocking said base in at least two different longitudinal positions along said slide-rail, said blocking means comprising a locking mechanism (35) provided with teeth which cooperate with tooth spaces on said slide-rail, and further comprising locking mechanism-control means (10) which move between an operative locking position in which said locking mechanism blocks said base on said slide-rail, and an inoperative adjustment position in which said locking mechanism retracts and allows longitudinal sliding of said base along said slide-rail, said locking mechanism being returned elastically to an operative locked position, wherein said device further comprises self-blocking means (58, 59, 60, 61) for automatically blocking said locking mechanism in a locked position as soon as a longitudinal thrust in a direction away from a second binding is exerted on said body of said binding, and for keeping said locking mechanism blocked until a longitudinal thrust is exerted in the opposite direction on said body of said binding.

7. Device according to claim 6, wherein said locking mechanism (35) moves transversely and is guided for such movement in a flared housing (41) allowing said locking mechanism to describe a swinging movement in a horizontal plane, said movement being controlled by a voluntary maneuver causing said base (9) to shift longitudinally due to engagement of teeth of said locking mechanism with the tooth spaces of said slide-rail which retains said base in a longitudinal direction.

8. Device according to claim 6, wherein the front end of said tongue (13) is fastened to said slide-rail (8) and the rear end of said tongue is engaged beneath said base (15) of said second binding, where said tongue can freely slide longitudinally.

9. Device according to claim 7, wherein, in one of the positions of the swinging movement, said blocking means (58, 59, 60, 61) are operational to block said locking mechanism (35) in locking position, and, in the other end position, said blocking means are inoperative.

10. Device according to claim 9, wherein said blocking means comprise, for one of said locking mechanism and said housing, a linger (58) positioned obliquely in relation to the longitudinal direction, and, for the other of said locking mechanism and said housing, a groove (59) adapted to house said finger, and wherein, in the locked position of said locking mechanism, said finger (58) is positioned outside of said groove (59) and in one of the end positions of said swinging movement, said finger is offset in relation to the alignment of said groove, thereby locking said locking mechanism in locked position, and, in the other end position of said swinging movement, said finger is positioned in the alignment with said groove, thereby allowing said locking mechanism to move from an operative to its inoperative position.

11. Device according to claim 9, wherein said blocking means comprise a stop (60) projecting on a lateral edge of said locking mechanism, which stop cooperates with a stop (61) projecting on the lateral edge of said housing, and wherein, in one of the end positions of said swinging movement, said two stops are in mutual abutment, thereby blocking said locking mechanism in operative locked position, and, in the other position of said swinging movement, said stop (60) on said locking mechanism disengages from the stop (61) on said housing, thereby allowing said locking mechanism to move from operative to inoperative position of said locking mechanism.

12. Device according to claim 9, wherein an elastic return means (40) elastically returns said locking mechanism to an end position of the swinging movement, in which said blocking means are operative.

13. Device according to claim 12, wherein said elastic return device is said locking mechanism-return spring (40) extending in an intermediate direction between the oblique direction in which said locking mechanism moves so as to travel from operative to non-operative position of said locking mechanism, and the longitudinal direction, so as to exert simultaneously an elastic action drawing said locking mechanism back into operative position and into the end position of the swinging movement corresponding to the operative position of said blocking means.

14. Device according to claim 13, wherein said spring (40) elastically draws said base (9) back into a position corresponding to the operative position of said blocking means (58, 59, 60, 61).

15. Device according to claim 6, wherein said slide-rail (8) is extended rearward by a tongue (13), in relation to which said base plate (9) moves longitudinally, and said tongue (13) bears reference marks (16) making it possible to identify the longitudinal position of said base plate (9).

* * * * *

UNITED STATES PATENT AND TRADEMARK OFFICE

CERTIFICATE OF CORRECTION

PATENT NO. : 5,348,335

DATED : September 20, 1994

INVENTOR(S) : Desarmaux et al

It is certified that error appears in the above-indentified patent and that said Letters Patent is hereby corrected as shown below:

On the cover page, item [75], correct the spelling of the first inventor to --DESARMAUX--.

In column 10, claim 10, line 13, change "linger" to --finger--.

Signed and Sealed this

Eleventh Day of April, 1995

*Attest:*

BRUCE LEHMAN

*Attesting Officer*

*Commissioner of Patents and Trademarks*